US008061809B2

(12) United States Patent
Ikegame et al.

(10) Patent No.: US 8,061,809 B2
(45) Date of Patent: Nov. 22, 2011

(54) LIQUID EJECTION HEAD

(75) Inventors: Ken Ikegame, Atsugi (JP); Shingo Nagata, Kawasaki (JP); Shigeki Fukui, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 378 days.

(21) Appl. No.: 12/333,195

(22) Filed: Dec. 11, 2008

(65) Prior Publication Data

US 2009/0153620 A1 Jun. 18, 2009

(30) Foreign Application Priority Data

Dec. 14, 2007 (JP) ..... 2007-323673

(51) Int. Cl.
*B41J 2/14* (2006.01)

(52) U.S. Cl. ..... 347/47

(58) Field of Classification Search ..... 347/47
See application file for complete search history.

(56) References Cited

U.S. PATENT DOCUMENTS 6,106,096 A 8/2000 Komplin
6,799,831 B2 10/2004 Inamoto

FOREIGN PATENT DOCUMENTS

CN 1101755 2/2003
CN 1241743 2/2006

*Primary Examiner* — Geoffrey Mruk
(74) *Attorney, Agent, or Firm* — Canon USA Inc. IP Division

(57) ABSTRACT

A liquid ejection head includes a substrate having a supply port through which liquid is supplied and a plurality of energy generating elements provided along the supply port and generating energy for ejecting the liquid, a nozzle plate having nozzles provided therein in correspondence with the energy generating elements, and a channel provided between the substrate and the nozzle plate. The nozzle plate has a groove surrounding the channel. The groove includes a first groove provided in one surface of the nozzle plate at which the nozzle plate is bonded to the substrate, and a second groove provided in another surface of the nozzle plate in which the nozzles are provided. Edges of the first groove have sawtooth shape with a number of very small notches and edges of the second groove are substantially straight.

6 Claims, 8 Drawing Sheets

LIQUID EJECTION HEAD

BACKGROUND OF THE INVENTION

1. Field of the Invention

The present invention relates to liquid ejection heads that perform recording on a target surface by ejecting liquid in a form of droplets, and in particular to inkjet recording heads that each include a nozzle plate having nozzles through which ink is ejected and a substrate having energy generating elements.

2. Description of the Related Art

A so-called side-shooter recording head includes a substrate, a nozzle plate having nozzles provided therein in correspondence with energy generating elements provided on the substrate, and channels provided therebetween.

Referring to FIG. 7, an exemplary known technique is disclosed in U.S. Pat. No. 6,799,831, in which a row of nozzles provided along each of supply ports is surrounded by a groove for preventing separation of a nozzle plate from a substrate. A recording head H1101 shown in FIG. 7 has a plurality of nozzles 6 and grooves 3 each surrounding a group of the nozzles 6. Since the coefficients of linear expansion of the substrate, the nozzle plate, and a tank case (a substrate holding member) that holds the substrate are different, if heat is generated during printing or if the environment in which the recording head is stored changes, the interfaces between the components are subjected to stresses. Such stresses include a stress due to hardening shrinkage of an adhesive or a sealant for bonding or sealing the tank case and the substrate. Moreover, the substrate itself of the recording head is easy to be deformed because of the supply ports provided therein.

Such stresses are particularly influential on regions where the nozzle plate ends (ends of the nozzle plate), i.e., ends of channel walls defining the channels, and the grooves provided around the nozzles and the channels. Therefore, separation of the nozzle plate from the substrate may occur. To avoid the separation, the grooves 3 according to the technique disclosed in U.S. Pat. No. 6,799,831 have a sawtooth shape, thereby relaxing stresses applied to the joint between the substrate and the nozzle plate.

However, it has been found that the sawtooth-shaped groove may trigger another problem. In general, when a printer is activated, foreign substances such as paper lint and dust are generated from a recording medium. If printing is performed with foreign substances caught on the surface of the nozzle plate, characteristics including wettability of the surface of the nozzle plate may change. In some cases, such foreign substances may cover some of the nozzles, resulting in defective print such as deflection of the ejecting direction and no ejection of ink.

To solve such a problem, some known printers having recording heads each include a mechanism that removes foreign substances that are caught around nozzles so as to perform stable ejection. In general, such a mechanism includes a recovery pump and a wiping member. FIG. 9 shows an exemplary recovery pumping mechanism provided for a recording head 1000. Referring to FIG. 9, the recovery pumping mechanism, which includes a capping member 13 that caps a recording head, pumps foreign substances caught on the surface of the nozzle plate and a little amount of ink from the recording head. Subsequently, ink remaining on the surface of the nozzle plate after the pumping by the recovery pumping mechanism is removed by a wiping member 12.

Recently, however, there has been a demand for realizing a low-cost printer body by excluding such a recovery pumping mechanism but without deteriorating performance. If the recovery pumping mechanism is excluded, the recovery operation only includes wiping of the surface of the nozzle plate with the wiping member. Referring to FIG. 8, if a foreign substance 8 such as paper lint is caught by the groove 3 provided in the nozzle plate because the groove 3 has a sawtooth shape, it is difficult in some cases to remove foreign substances only by wiping. If foreign substances remain caught around the nozzles 6, characteristics, including wettability, of the surface of the nozzle plate may change and some of the nozzles may be clogged, resulting in defective print such as deflection of the ejecting direction and no ejection of ink.

SUMMARY OF THE INVENTION

In light of the above, the present invention provides a liquid ejection head provided with grooves for the purpose of securing adhesion between a nozzle plate and a substrate while suppressing foreign substances from being caught around the grooves. In the liquid ejection head, even if any foreign substances are caught around the grooves, such substances can be removed easily.

According to a first aspect of the present invention, a liquid ejection head includes a substrate having a supply port through which liquid is supplied and a plurality of energy generating elements provided along the supply port and generating energy for ejecting the liquid, a nozzle plate having nozzles provided therein in correspondence with the energy generating elements, and a channel provided between the substrate and the nozzle plate. The nozzle plate has a groove surrounding the channel. The groove including a first groove provided in one surface of the nozzle plate at which the nozzle plate is bonded to the substrate, and a second groove provided in another surface of the nozzle plate in which the nozzles are provided. Edges of the first groove have a sawtooth shape with a number of very small notches and edges of the second groove are substantially straight.

According to a second aspect of the present invention, a liquid ejection head includes a substrate having a supply port through which liquid is supplied and a plurality of energy generating elements provided along the supply port and generating energy for ejecting the liquid, a nozzle plate having nozzles provided therein in correspondence with the energy generating elements, and a channel provided between the substrate and the nozzle plate. The nozzle plate has a groove surrounding the channel. The groove including a first groove provided in one surface of the nozzle plate at which the nozzle plate is bonded to the substrate, and a second groove provided in another surface of the nozzle plate in which the nozzles are provided. Edges of the first groove have a sawtooth shape with a number of very small notches and edges of the second groove are curved.

In the liquid ejection head according to the first or second aspect of the present invention, adhesion between the nozzle plate and the substrate can be secured while foreign substances can be suppressed from being caught around the grooves. Moreover, even if any foreign substances are caught around the grooves, such substances can be removed easily.

Further features of the present invention will become apparent from the following description of exemplary embodiments with reference to the attached drawings.

DESCRIPTION OF THE EMBODIMENTS

Exemplary embodiments of the present invention will now be described with reference to the drawings.

Figure 5:
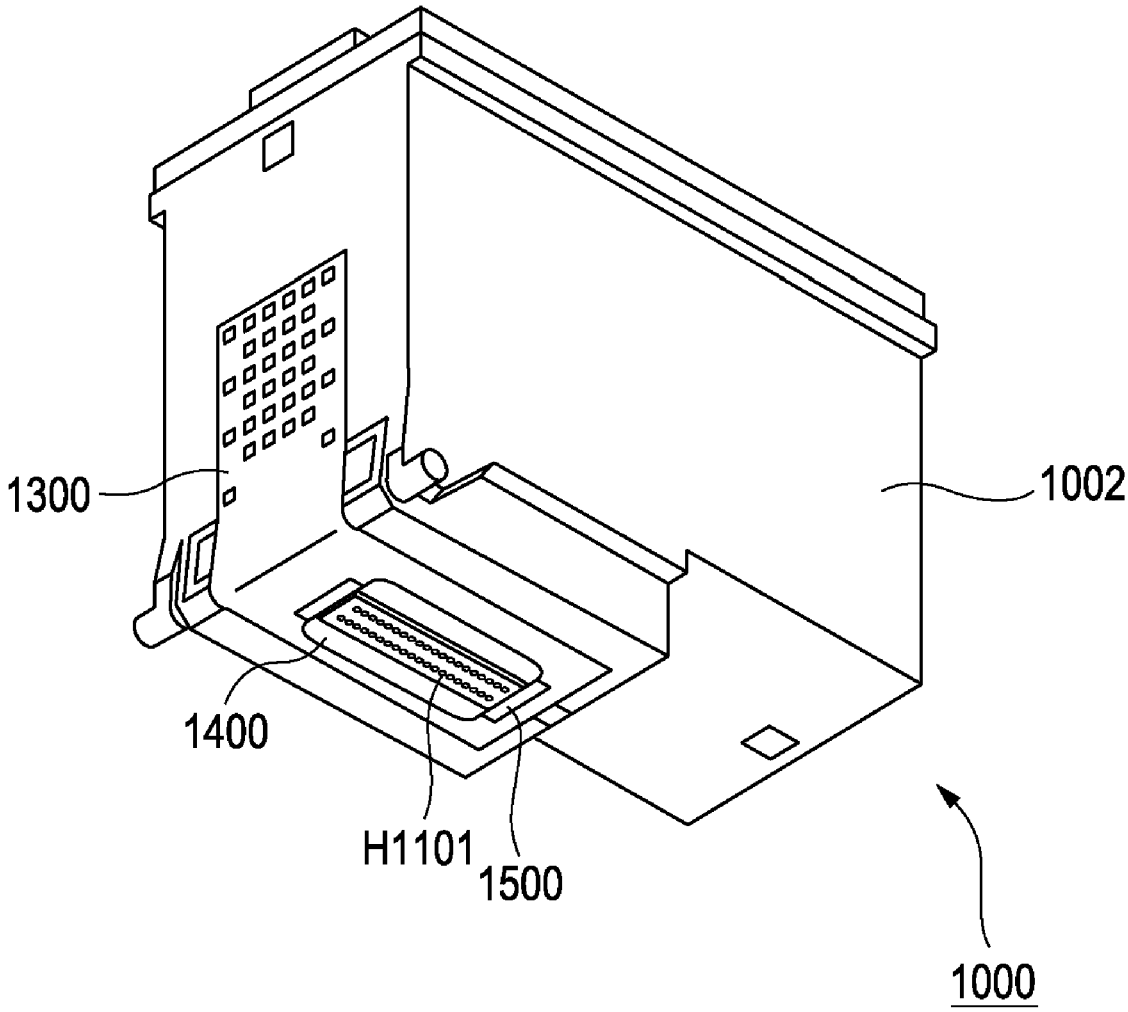
FIG. 5 is a perspective view of a liquid ejection head according to an exemplary embodiment of the present invention.
Figure 6:
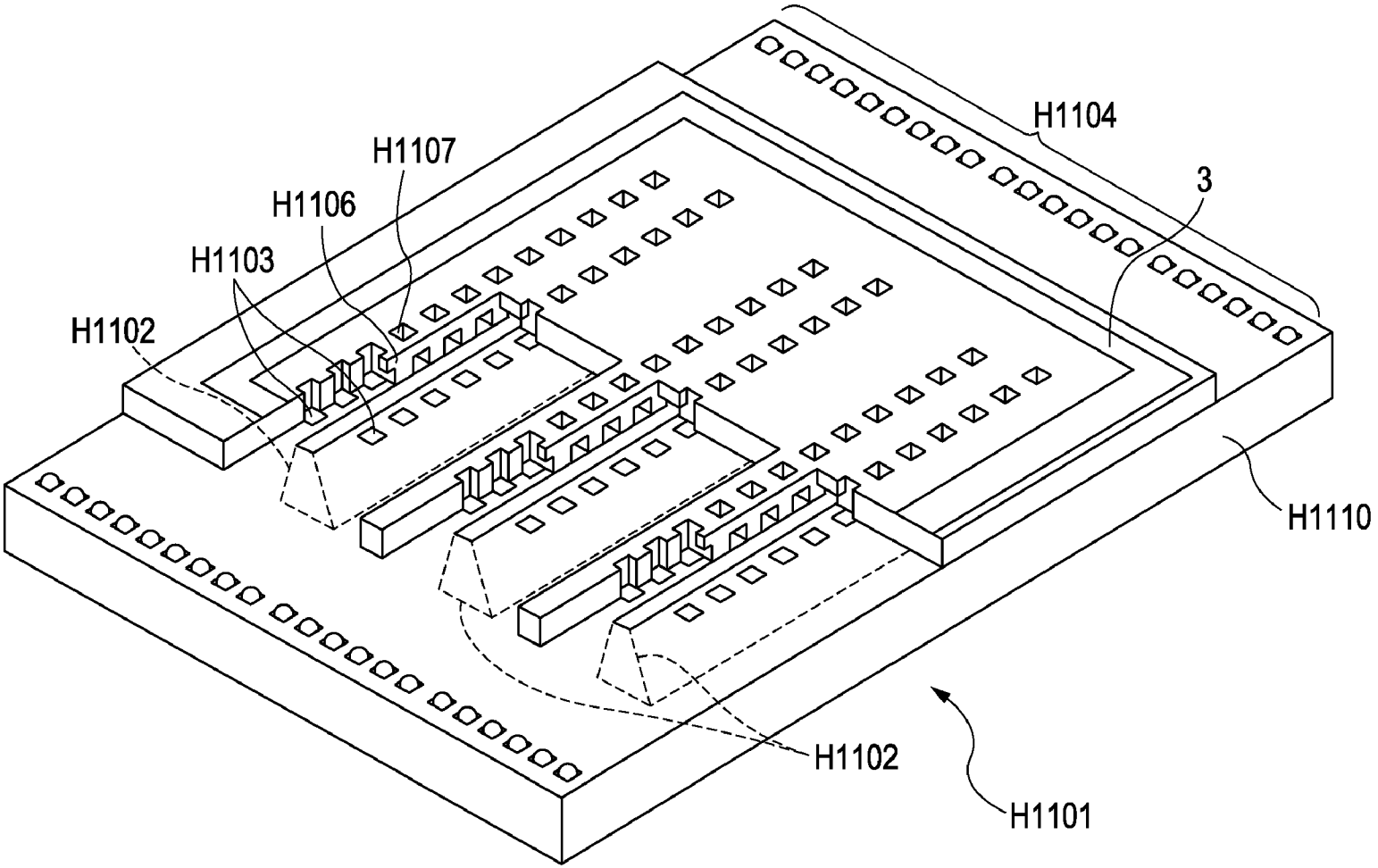
FIG. 6 is a perspective view of a recording head according to the exemplary embodiment of the present invention.
Figure 7:
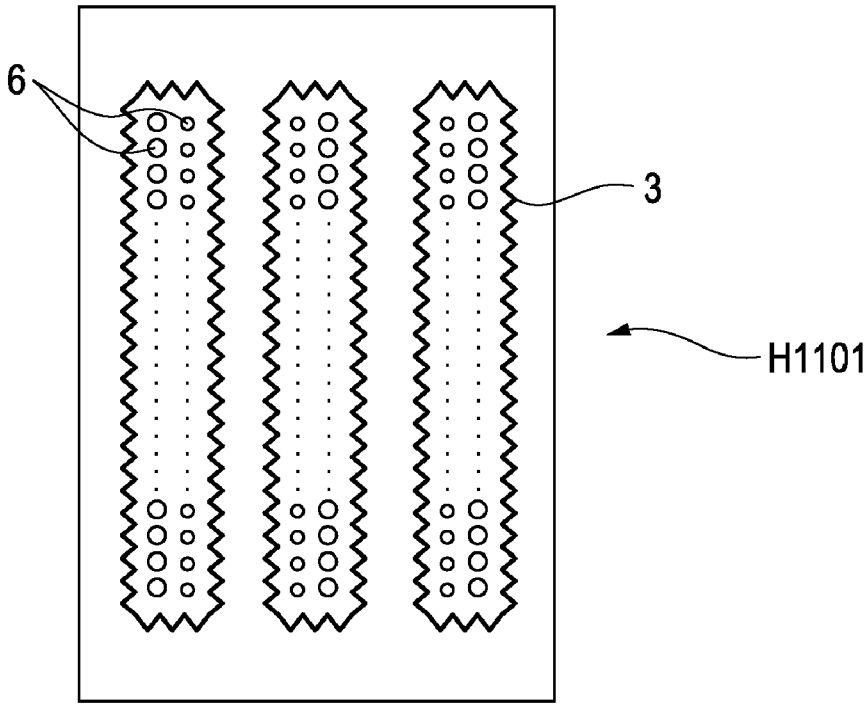
FIG. 7 PRIOR ART
FIG. 7 is a top view of a known recording head.
Figure 8:
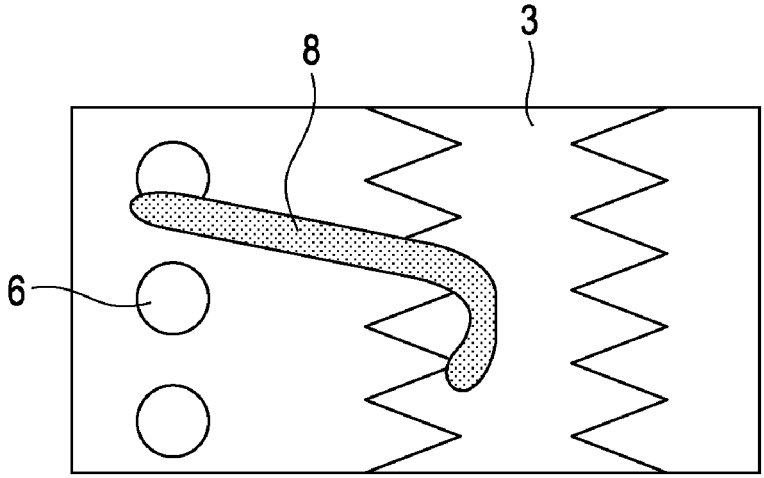
FIG. 8 PRIOR ART
FIG. 8 schematically shows the known recording head.
Figure 9:
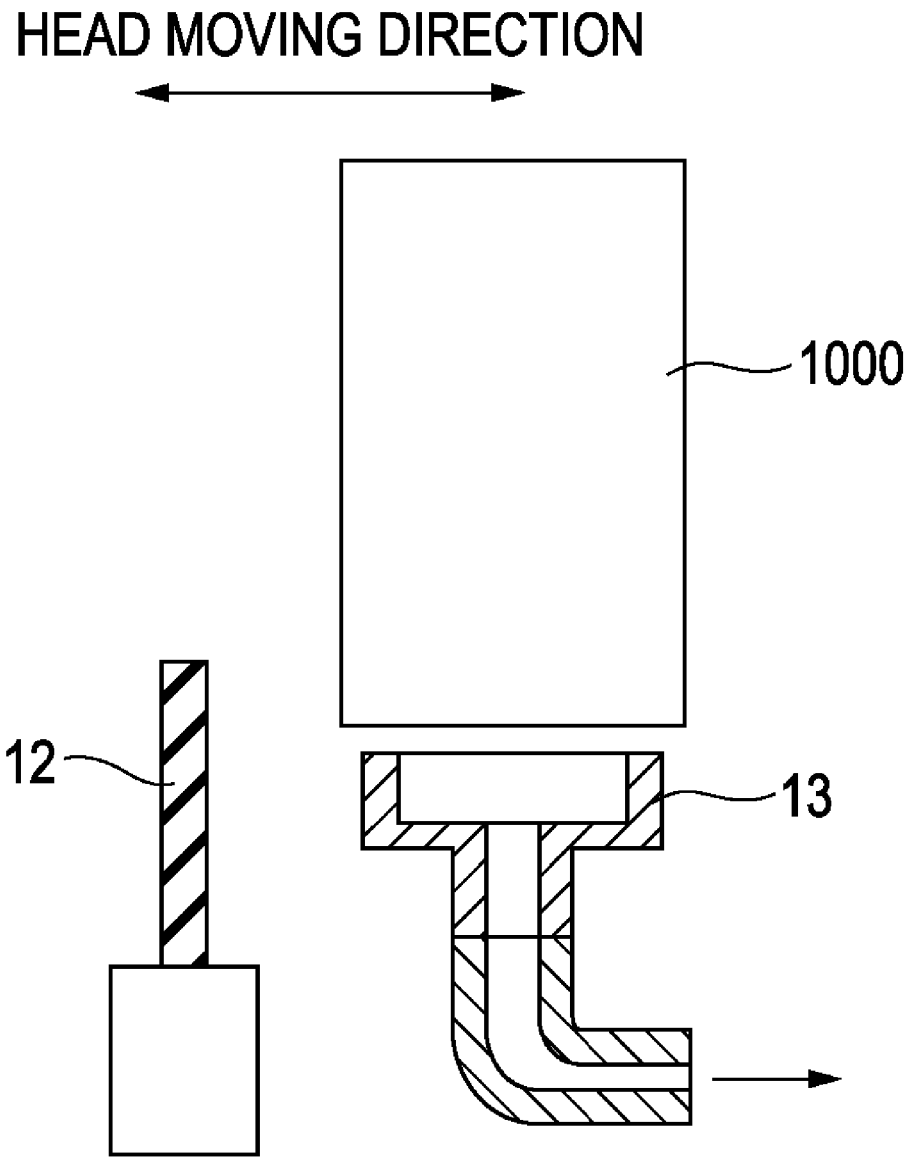
FIG. 9 PRIOR ART
FIG. 9 schematically shows a recovery mechanism included in a known printer.

A recording head according to an exemplary embodiment of the present invention is provided integrally with an ink tank. FIGS. 5 and 6 each show an exemplary liquid ejection head and a recording head, respectively, that eject ink of three colors of cyan, magenta, and yellow.

Referring to FIG. 6, a recording head (liquid ejection head) H1101 includes supply ports H1102 for the respective colors, rows of electrothermal transducers H1103 serving as energy generating elements disposed on both sides of each of the supply ports H1102, and rows of nozzles H1107 provided in correspondence with the electrothermal transducers H1103. A silicon substrate H1110 is provided with electrical wiring (not shown), an electrode section H1104, and so forth. A nozzle plate H1106 made by photolithographically processing a resin material overlies the substrate H1110. The nozzle plate H1106, having the nozzles H1107, and the substrate H1110 in combination provide channels defined therebetween by channel walls. In FIG. 6, a groove 3 is provided so as to surround the channels and to extend through the nozzle plate H1106.

A liquid ejection head cartridge 1000 will be described with reference to FIG. 5. Referring to FIG. 5, an ink supplying/retaining member (a tank case) 1002 is made by molding a resin material, for example, and also serves as a substrate holding member that holds the substrate H1110. In the exemplary embodiment of the present invention, the recording head H1101 is bonded to the ink supplying/retaining member 1002 with high positional accuracy so that the supply ports H1102 provided in the substrate H1110 communicate with respective supply openings provided in the ink supplying/retaining member 1002. The adhesive used in bonding the recording head H1101 to the ink supplying/retaining member 1002 is desired to have a low viscosity, to be cured at a low temperature and in a short time, and to be resistant to ink. Specifically, a desirable bonding layer is made of thermosetting adhesive composed mainly of epoxy resin and has a thickness of about 50 μm.

The recording head H1101 is electrically connected to an electrical wiring tape 1300. A first sealant 1400 and a second sealant 1500 provided between the recording head H1101 and the ink supplying/retaining member 1002 prevent ink from gathering around the ends (in the longitudinal direction) of the substrate H1110 and protect the electrical connections from corrosion due to ink and external impact.

Figure 1A:
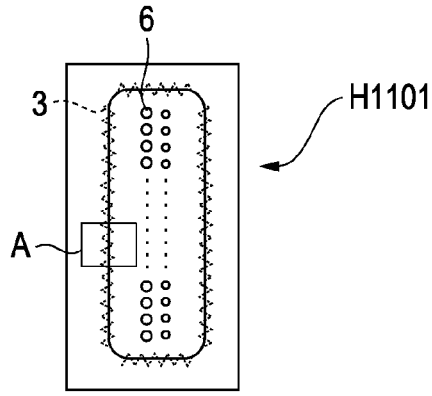
FIGS. 1A to 1G are top views and cross-sectional views showing recording heads according to a first embodiment and a second embodiment of the present invention.
Figure 1B:
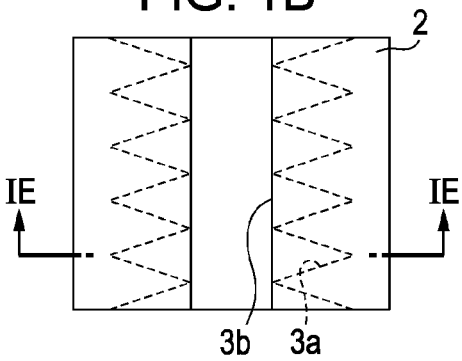
Figure 1E:
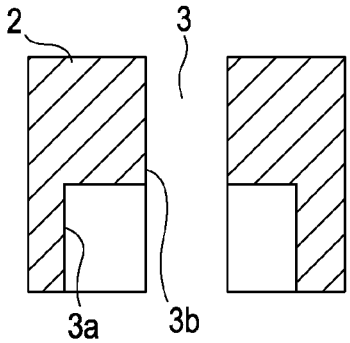

FIGS. 1A, 1B, and 1E show a first embodiment of the present invention. FIG. 1A is a top view of the recording head H1101. FIG. 1B is an enlarged schematic top view of a region A shown in FIG. 1A. FIG. 1E is a cross-sectional view taken along the line IE-IE shown in FIG. 1B. Each of the recording head H1101 shown in FIGS. 1A, 1B, and 1E includes a substrate 1 (see FIG. 2E), a nozzle plate 2, a groove 3 including a first groove 3*a* and a second groove 3*b*, and nozzles 6.

The substrate 1 is made of a silicon semiconductor substrate or the like processed by a semiconductor manufacturing technique. In the first embodiment, the substrate 1 has a substantially rectangular shape and is provided with a supply port 9 (see FIG. 2G) as a through-hole extending in the center thereof in the longitudinal direction. A plurality of energy generating elements 4 (see FIG. 2E) are provided on both sides of the supply port 9. The energy generating elements 4 heat ink supplied through the supply port 9 so as to foam the ink, thereby causing ink droplets to be ejected through the nozzles 6.

Figure 2A:
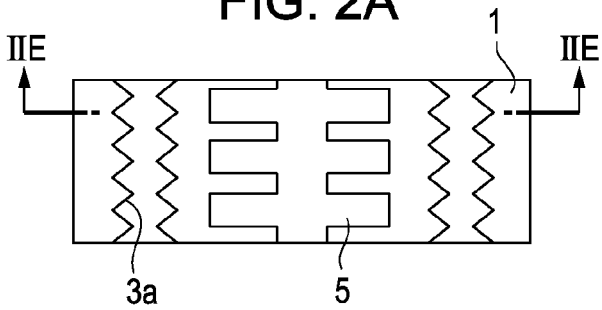
FIGS. 2A to 2H show steps of manufacturing the recording head according to the first embodiment of the present invention.
Figure 2E:
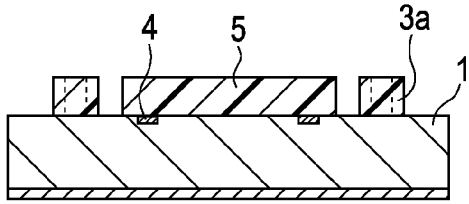

FIGS. 2A to 2H show steps of manufacturing the recording head according to the first embodiment. FIG. 2A is a top view of the recording head. FIG. 2E is a cross-sectional view taken along the line IIE-IIE in FIG. 2A.

Figure 2B:
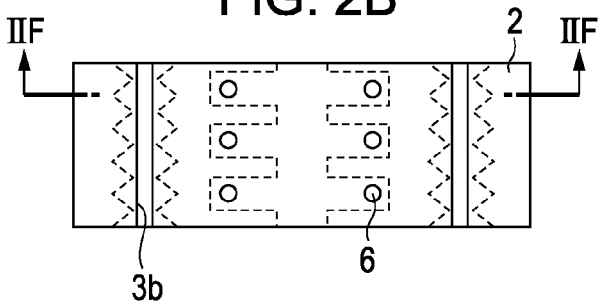
Figure 2F:
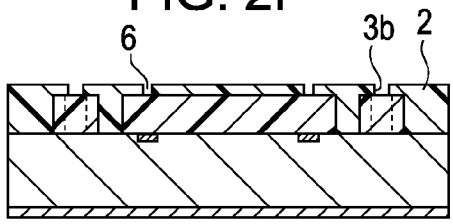

A sample of the recording head according to the first embodiment was manufactured in accordance with the steps shown in FIGS. 2A to 2H. First, a channel forming member 5 composed of a positive resist or the like was provided over the substrate 1 having wiring (not shown) thereon. The channel forming member 5 was photolithographically processed, whereby a channel 7 and the first groove 3*a* were provided. In this step, the edges of the first groove 3*a* were shaped like teeth of a saw. The interval between the sawtooth-shaped edges was set to be 20 μm at the narrowest points. Subsequently, referring to FIGS. 2B and 2F, a nozzle material to become the nozzle plate 2 was provided over the channel forming member 5 and is photolithographically processed, whereby the nozzles 6 and the second groove 3*b* were provided. In this step, the first groove 3*a* contributes to evening the thickness of the nozzle material applied thereover while preventing the level of the nozzle material near ends of the substrate 1 from being lower than the level at other regions. Referring to FIG. 2B, the edges of the second groove 3*b* were shaped so as to be substantially straight, and the interval between the edges was set to be 20 μm, whereby the entirety of the first groove 3*a* was covered with the nozzle material. Since the nozzle material is to be in contact with ink or the like, the nozzle material is desirably composed of resin resistant to ink, or more specifically photocurable epoxy resin of negative type.

In the first embodiment, the first groove 3*a* is provided in one surface of the nozzle plate 2 at which the nozzle plate 2 is bonded to the substrate 1, with the edges having a number of very small notches like the teeth of a saw. In contrast, the second groove 3*b* is provided in the other surface of the nozzle plate 2 in which the nozzles 6 are provided, with the substantially straight edges.

Figure 2C:
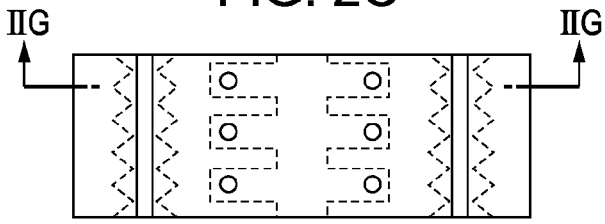
Figure 2G:
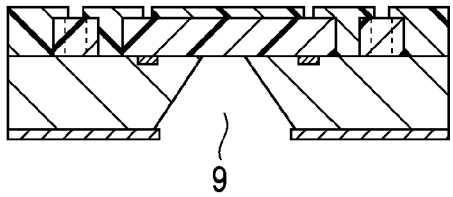
Figure 2D:
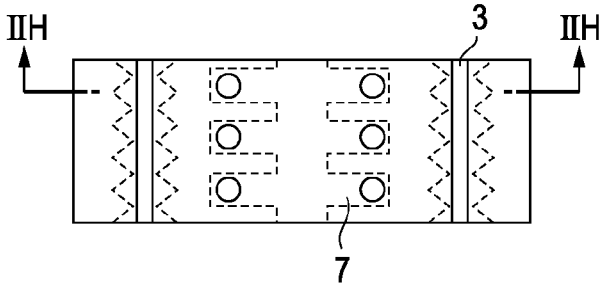
Figure 2H:
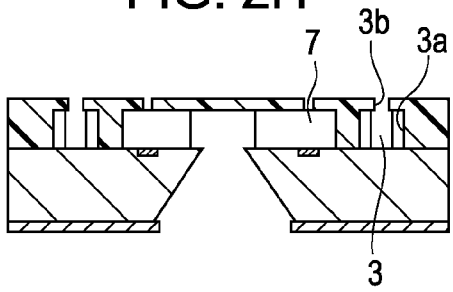

Subsequently, referring to FIGS. 2C and 2G, the supply port 9 was provided by anisotropic etching or the like. Then, referring to FIGS. 2D and 2H, the channel forming member 5 was removed by applying a solvent or the like thereto, whereby the channel 7 was provided. Thus, the sample recording head was obtained. The sample recording head obtained as above was electrically connected to the electrical wiring tape 1300 (see FIG. 5) and was bonded to the ink supplying/retaining member 1002 with an adhesive and a sealant. In this manner, a sample liquid ejection head was manufactured.

A temperature cycle test was performed using the sample liquid ejection head manufactured as above. Specifically, the temperature of the liquid ejection head was held at 60° C. for two hours and then was reduced to −30° C. at a constant speed spending two hours. After the temperature was held at −30° C. for two hours, the temperature was raised to 60° C. at a constant speed spending two hours. This cycle was repeated ten times.

The test showed no serious separation of the nozzle plate 2 from the substrate 1 at the edges of the groove 3 of the sample liquid ejection head of the first embodiment. Although very slight separation was observed, such separation leads to substantially no problem. In test printings performed with the sample liquid ejection head before and after the temperature cycle test, no changes were observed therebetween and satisfactory results were obtained.

Next, paper lint was sprinkled over the nozzle surface of the nozzle plate 2 and a test for checking foreign substance removability of a wiping mechanism 12 included in the body of the recording apparatus was performed. In this test, no pumping mechanism but only the wiping mechanism 12 was used. The test showed that the sprinkled paper lint was removed only by wiping with the wiping mechanism 12. In test printings performed with the sample liquid ejection head before and after the paper lint test, no changes were observed therebetween and satisfactory results were obtained.

If wiping is repeated with some foreign substances remaining caught by the groove 3, stresses are concentrated at portions of the groove 3 having such foreign substances. However, with the second groove 3*b* having substantially straight edges and the first groove 3*a* having sawtooth-shaped edges, any local stresses applied to the second groove 3*b* because of foreign substances caught thereby can be dispersed by the first groove 3*a*.

Figure 1C:
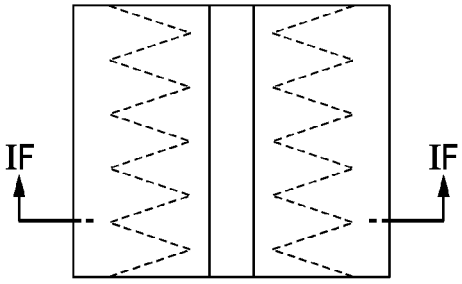
Figure 1F:
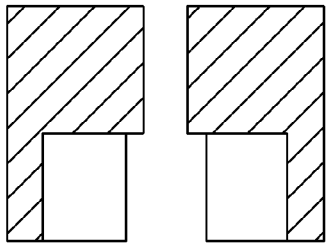

In the first embodiment, the interval between the edges of the groove provided in the nozzle surface is set to 20 μm. Among foreign substances including paper lint, silicon particles, and so forth observed in the above test, most of such substances were pieces of paper lint, with the smallest piece having a width of about 20 μm. Therefore, by setting the width of the groove to be 20 μm or smaller, foreign substances are prevented from being frequently caught by the groove and any foreign substances can be removed only by wiping them off. The width of the groove, which is 20 μm in the first embodiment, may be smaller than 20 μm, as shown in FIGS. 1C and 1F, as long as a width sufficient for removing the channel forming member therethrough is secured. Specifically, the width of the second groove 3*b* only needs to be smaller than or equal to the width of the first groove 3*a* at the narrowest points. To summarize, the second groove 3*b* with edges having no bends prevents foreign substances from being caught thereby. Moreover, even if any substances are caught around the groove, such substances can be removed easily.

Figure 4A:
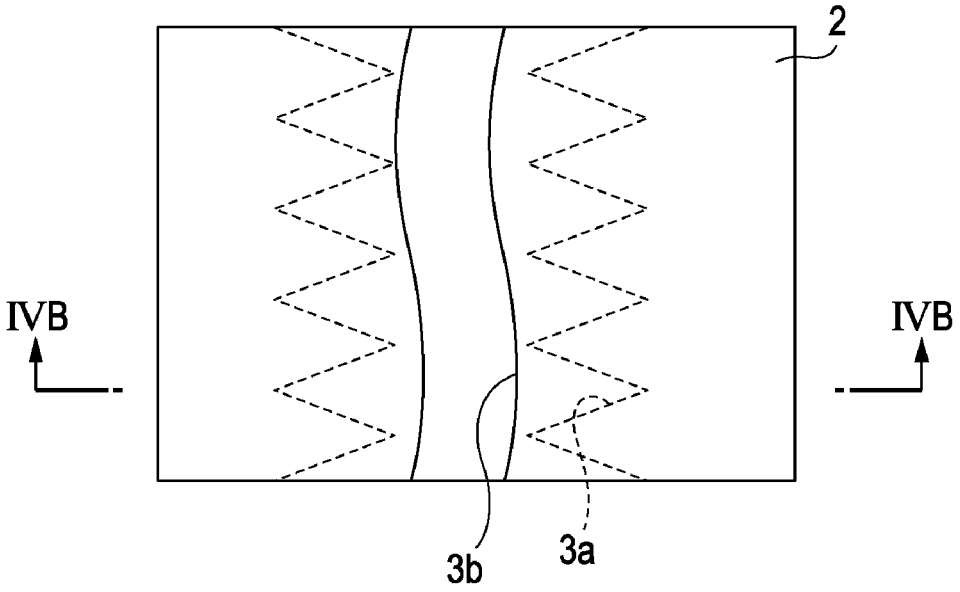
FIGS. 4A and 4B are a top view and a cross-sectional view of a modification of the recording head according to the first embodiment of the present invention.
Figure 4B:
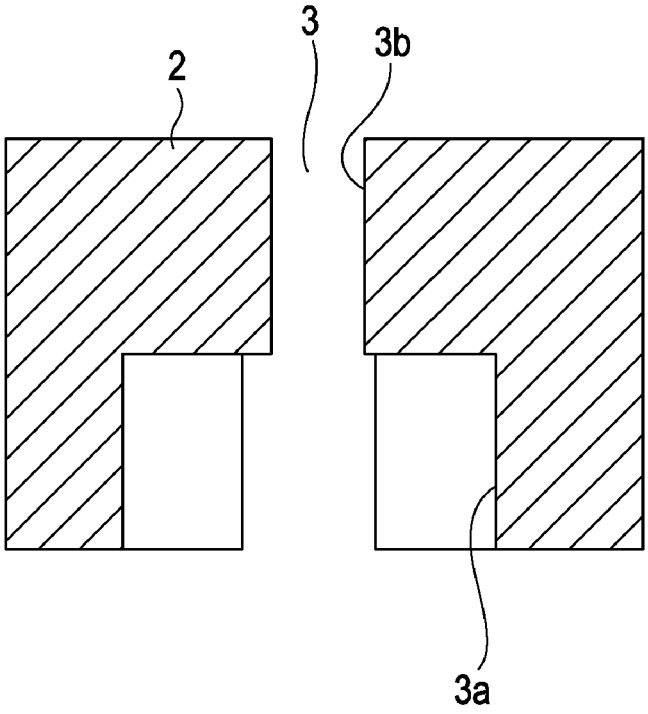

In addition, the second groove 3*b*, which is provided so as to be substantially straight in the first embodiment, may be provided so as to be continuously curved, as shown in FIG. 4A and FIG. 4B, a cross-sectional view of FIG. 4A. In such a case, the curve needs to be sufficiently gentle so as not to catch foreign substances during the wiping operation performed with the wiping mechanism 12.

Figure 1D:
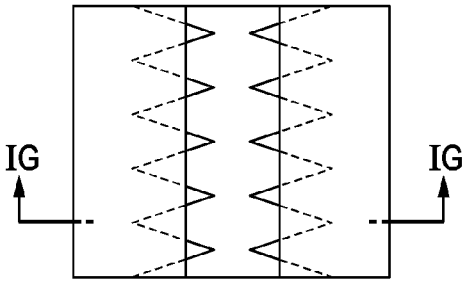
Figure 1G:
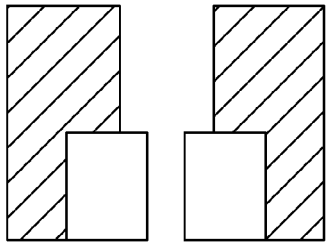

FIGS. 1D and 1G each show a recording head according to a second embodiment of the present invention. FIG. 1D is an enlarged schematic top view of the region A shown in FIG. 1A. FIG. 1G is a cross-sectional view taken along the line IG-IG in FIG. 1D. FIGS. 3A to 3H show steps of manufacturing the recording head according to the second embodiment.

Figure 3A:
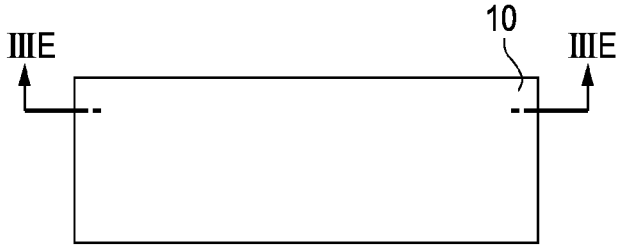
FIGS. 3A to 3H show steps of manufacturing the recording head according to the second embodiment of the present invention.
Figure 3E:
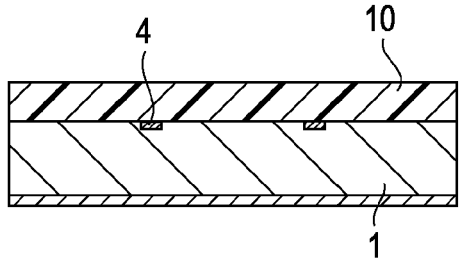
Figure 3B:
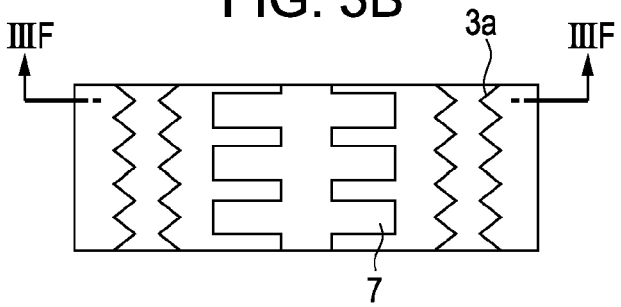
Figure 3F:
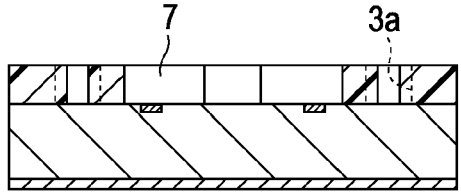
Figure 3C:
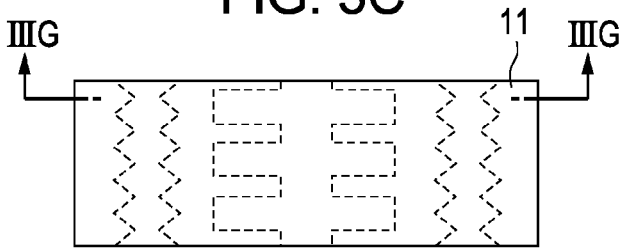
Figure 3G:
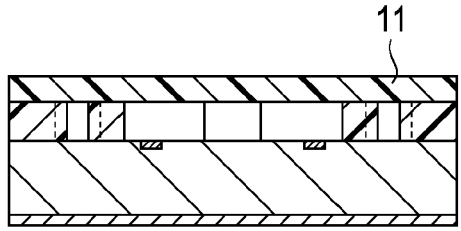
Figure 3D:
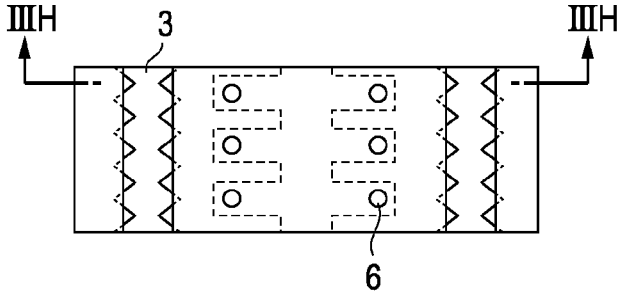
Figure 3H:
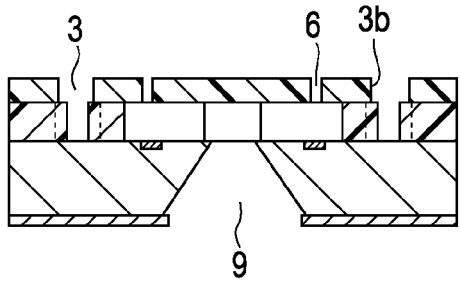

A sample of the recording head according to the second embodiment was manufactured in accordance with the steps shown in FIGS. 3A and 3E. First, a first nozzle plate 10 was provided on a substrate 1 having wiring (not shown). The first nozzle plate 10, which is to be in contact with ink or the like, can be composed of resin that is resistant to ink or, specifically, photocurable epoxy resin of negative type. Subsequently, referring to FIGS. 3B and 3F, the first nozzle plate 10 was photolithographically processed so that regions corresponding to a channel 7 and a first groove 3*a* were removed. In this step, edges of the first groove 3*a* were shaped like teeth of a saw. The interval between the sawtooth-shaped edges was set to be 5 μm at the narrowest points. Then, referring to FIGS. 3C and 3G, a material to become a second nozzle plate 11 was provided over the first nozzle plate 10. The material to become the second nozzle plate 11 had been separately formed, by application, as a dry film having a uniform thickness, and was laminated over the first nozzle plate 10. Like the first nozzle plate 10, the second nozzle plate 11, which is to be in contact with ink or the like, can be composed of resin that is resistant to ink or, specifically, photocurable epoxy resin of negative type. The materials for the first nozzle plate 10 and the second nozzle plate 11 may be either the same or different, depending on circumstances considering adhesion with the substrate 1, for example. Subsequently, the second nozzle plate 11 was photolithographically processed, whereby nozzles 6 and a second groove 3*b* were provided therein. In this step, the edges of the second groove 3*b* were shaped so as to be substantially straight, and the interval therebetween was set to be 20 μm. Further, anisotropic etching or the like was performed, whereby a supply port 9 was provided. Thus, a sample liquid ejection head shown in FIGS. 3D and 3H was obtained.

The sample liquid ejection head manufactured as above was subjected to a temperature cycle test and a paper lint test, in the same manner as described in the first embodiment. The tests showed neither separation at the groove nor remaining paper lint. In test printings performed with the sample liquid ejection head before and after the tests, no changes were observed therebetween and satisfactory results were obtained.

In the second embodiment, the groove 3 is provided in such a manner that tips of the teeth on the edges of the first groove 3*a* extend beyond the substantially straight-shaped edges of the second groove 3*b*. That is, the width of the first groove 3*a* is smaller than the width of the second groove 3*b*. In such a configuration, even if stresses are applied to the substantially straight-shaped edges during the wiping operation or the like, the tips of the sawtooth-shaped edges are less affected by the stresses. Therefore, the adhesion between the nozzle plate and the substrate is increased at the tips of the sawtooth-shaped edges, highly suppressing separation of the nozzle plate from the substrate.

The edges of the first groove 3*a* and the edges of the second groove 3*b*, which are of the same shape, respectively, in the first and second embodiments, may be of different shapes (i.e., asymmetric) depending on the wiping method and the type of foreign substances varying with the specifications of the printer apparatus itself. In addition, the groove with the sawtooth-shaped edges and the channel, which are of the same height in the first and second embodiments, may be of different heights depending on the same factors.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2007-323673 filed Dec. 14, 2007, which is hereby incorporated by reference herein in its entirety.

What is claimed is:

1. A liquid ejection head comprising:

a substrate having a supply port through which liquid is supplied and a plurality of energy generating elements provided along the supply port and generating energy for ejecting the liquid;

a nozzle plate, disposed on the substrate, having nozzles provided therein in correspondence with the energy generating elements; and a channel provided between the substrate and the nozzle plate, wherein the nozzle plate has a groove surrounding the channel and extending through the nozzle plate, the groove including a first groove portion provided in one surface of the nozzle plate at which the nozzle plate is bonded to the substrate, and a second groove portion provided in another surface of the nozzle plate in which the nozzles are provided, and wherein openings of the first groove portion in the one surface have a sawtooth shape with a number of notches and openings of the second groove portion in the another surface are substantially straight.

2. The liquid ejection head according to claim 1, wherein a width of the second groove portion is smaller than or equal to a width at a narrowest point of the first groove portion.

3. The liquid ejection head according to claim 1, wherein a width of the second groove portion is larger than a width at a narrowest point of the first groove portion.

4. A liquid ejection head comprising:

a substrate having a supply port through which liquid is supplied and a plurality of energy generating elements provided along the supply port and generating energy for ejecting the liquid;

a nozzle plate, disposed on the substrate, having nozzles provided therein in correspondence with the energy generating elements; and a channel provided between the substrate and the nozzle plate, wherein the nozzle plate has a groove surrounding the channel and extending through the nozzle plate, the groove including a first groove portion provided in one surface of the nozzle plate at which the nozzle plate is bonded to the substrate, and a second groove portion provided in another surface of the nozzle plate in which the nozzles are provided, and wherein openings of the first groove portion in the one surface have a sawtooth shape with a number of notches and openings of the second groove portion in the another surface are curved.

5. The liquid ejection head according to claim 4, wherein a width of the second groove portion is smaller than or equal to a width at a narrowest point of the first groove portion.

6. The liquid ejection head according to claim 4, wherein a width of the second groove portion is larger than a width at a narrowest point of the first groove portion.

* * * * *